US005137603A

United States Patent [19]

Arthur, Jr. et al.

[11] Patent Number: 5,137,603

[45] Date of Patent: Aug. 11, 1992

[54] OVEN WALLS

[75] Inventors: Reuben B. Arthur, Jr.; Jerry W. Whitley; Harry R. Stowe, Jr., all of Greensboro, N.C.

[73] Assignee: Resco Products, Inc., Conshohocken, Pa.

[21] Appl. No.: 642,251

[22] Filed: Jan. 16, 1991

[51] Int. Cl.[5] ..... C10B 29/02

[52] U.S. Cl. ..... 202/139; 202/223; 202/268; 432/247

[58] Field of Search ..... 202/139, 223, 267.2, 202/268; 432/223, 247, 249

[56] References Cited

U.S. PATENT DOCUMENTS

| | | | |
|---|---|---|---|
| 1,430,027 | 9/1922 | Plantinga | 202/223 |
| 1,818,713 | 8/1931 | Hughes | 202/223 |
| 3,214,353 | 10/1965 | Beimann | 202/139 |
| 4,196,052 | 4/1980 | Szurman et al. | 202/223 |
| 4,239,600 | 12/1980 | Edgar | 202/138 |
| 4,565,605 | 1/1986 | Kruse | 202/139 |

FOREIGN PATENT DOCUMENTS

| | | | |
|---|---|---|---|
| 448533 | 7/1927 | Fed. Rep. of Germany | 202/223 |
| 581940 | 7/1933 | Fed. Rep. of Germany | 202/223 |

*Primary Examiner*—Joye L. Woodard

*Attorney, Agent, or Firm*—Seidel, Gonda, Lavorgna & Monaco

[57] ABSTRACT

The invention provides a construction block useful in the construction of coke oven combustion chamber assemblies. The construction block is a rectangularly-shaped unit comprises:

(a) an upper and lower wall surface, wherein the construction block's upper wall surface comprises at least one ridge or groove running along at least a portion of the longitudinal axis of the construction block's upper wall surface, and wherein the construction block's lower wall surface comprises at least one ridge or groove running along at least a portion of the longitudinal axis of the construction block's lower wall surface, (b) a left and right side wall surface, and (c) two end wall surfaces, wherein at least one of the two end wall surfaces is offset along the longitudinal axis of said construction block's upper and lower wall surfaces to define one-half of a horizontally-oriented, L-shaped lap joint.

2 Claims, 11 Drawing Sheets

FIG. 1
PRIOR ART
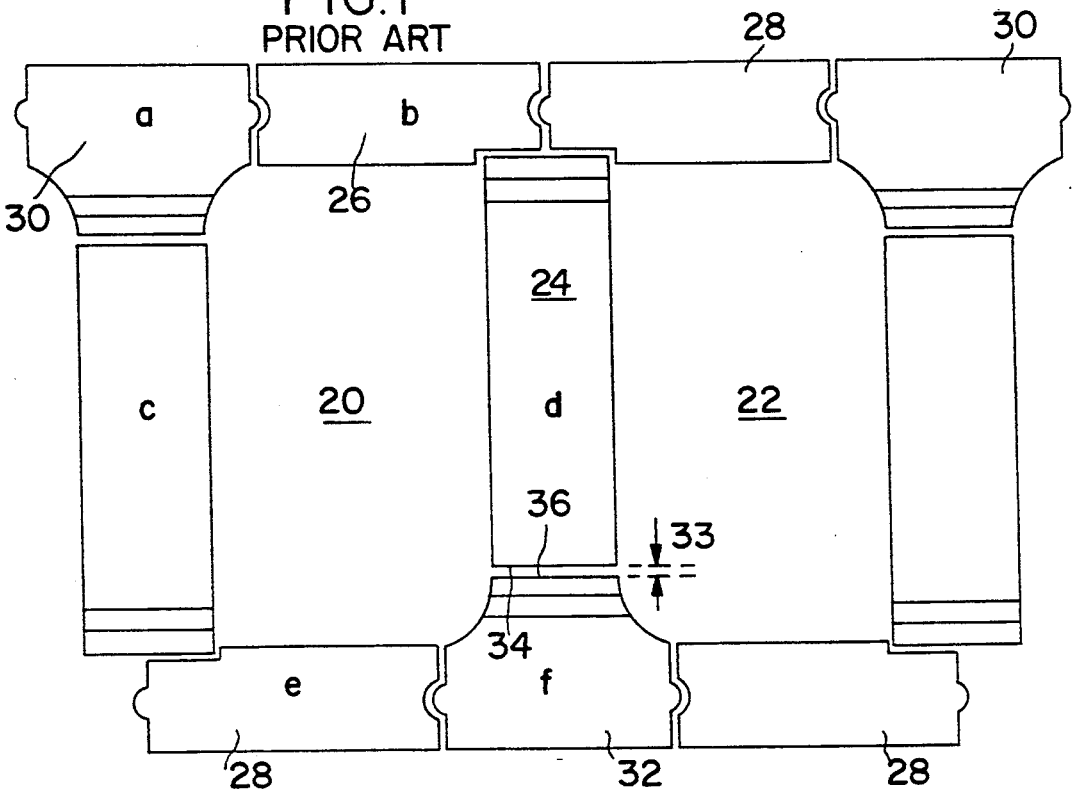
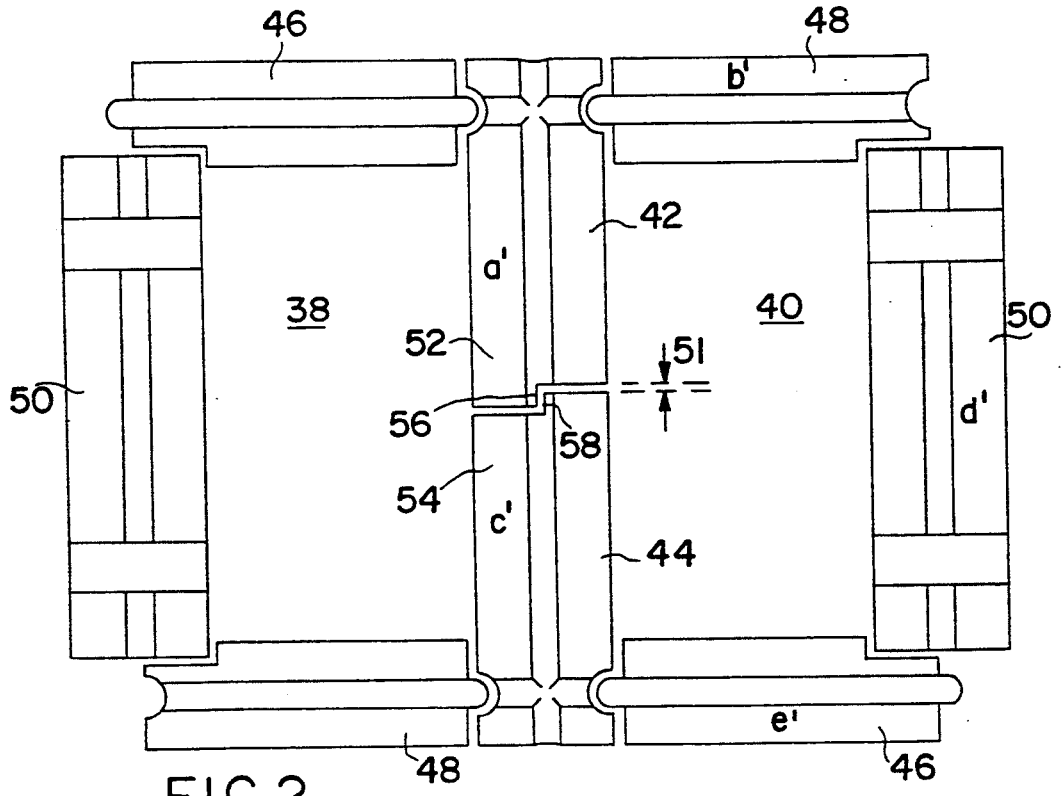
FIG. 2

OVEN WALLS

FIELD OF THE INVENTION

This invention relates to high temperature heat transfer structures. More particularly, this invention pertains to combustion chamber assemblies adapted to transfer heat in by-product coke ovens and the like.

BACKGROUND OF THE INVENTION

Coke ovens play a very substantial part in today's manufacturing industry. Although there are many different types, designs and styles of coke ovens, which depend largely upon the resources and specific requirements of the user, they all have many common characteristics and problems associated therewith.

For example, most coke ovens comprise a plurality of vertically-oriented combustion chamber assemblies spaced laterally from one another. The space defined between the outside wall surfaces of two adjacent combustion chamber assemblies is the heating chamber wherein the coal is transformed into coke and other useful by-products.

Each combustion chamber assembly, itself, comprises a plurality of vertically-oriented combustion flues separated from one another by interior dividing walls. These dividing walls are generally perpendicular to, and abut against, the inside wall surface of the combustion chamber assembly side walls.

Moreover, in most conventional combustion chamber assemblies, a "sight hole" is positioned at the upper end of the assembly. This "sight hole", which is generally aligned with the longitudinal axis of, and opens into, each combustion flue, is for manually looking into the combustion flue to see if there are any obstructions therein (e.g., refractory wall blocks which have shifted or fallen) and/or checking flue temperature.

In most conventional coke ovens, there are many structural requirements for their combustion chamber assemblies. These requirements often make the combustion assemblies difficult and costly to design and construct.

One example of a structural requirement is that, in many of the conventional coke ovens, adjacent combustion flues, within a particular combustion chamber assembly, operate in alternating "combustion" and "regeneration" modes. In other words, while one combustion flue is in the "up" or "combustion" mode, the adjacent combustion flues, within the same combustion chamber assembly, are in the "down" or "regeneration" mode. Then, after a predetermined period of time (e.g., from between about a half an hour to about an hour), those flues which are in the combustion mode are cycled to the regeneration mode and vice versa. In order for this cycling of combustion and regenerating gases to be energy efficient, gas seepage between adjacent combustion flues must be minimized.

In conventional coke ovens which employ such a cycling process of combustion and regeneration gases, the dividing wall separating adjacent combustion flues of a combustion chamber assembly generally consists of staggered refractory blocks which are laid one on top of another (see, e.g. FIG. 1 which will be discussed later). These blocks, which span the entire width of the combustion flue, and which have at least one straight "head joint" (i.e., the joint between the dividing wall end surfaces and the inside surface of the combustion chamber side walls) are typically mortared in place. The mortar and the abutting relationship at the "head joints" are conventionally relied upon to provide the seal between adjacent combustion flues.

Seals conventionally made by this manner, however, quickly deteriorate when subjected to the normal conditions encountered in typical coke ovens. Specifically, due to the alternating flow patterns of combustion and regeneration gases, there are rapid and large temperature swings within the individual combustion flues. This rapid and drastic temperature change results in a "thermal shock" to the construction material (e.g., silica blocks) which makes up both, the combustion flue dividing walls and the combustion chamber assembly outside walls. This thermal shock, in turn, causes the construction material to expand and contract.

As can be expected, the continual expansion and contraction of the refractory material causes the mortar seals at the head joints between the longitudinal ends of the combustion flue dividing walls and the combustion chamber assembly outside walls to deteriorate. Consequently, gas seepage often occurs between adjacent combustion flues, thus, greatly reducing the energy efficiency of the coke oven.

Due to the continual rising costs of energy sources, and the increasing public concern for energy conservation, the manufacturing industry would greatly welcome a means by which combustion chamber assemblies can be manufactured such that they provide an energy efficient seal between adjacent combustion flues.

Another structural requirement of combustion chamber assemblies is that they must be tapered along their horizontal axis. The purpose of this taper is to facilitate the expulsion of the coke from the heating chamber which has been formed therein.

Because of this taper, many different sized blocks are needed to construct combustion chamber assemblies. For the builder of such combustion chamber assemblies, this generally means that they need to have a large inventory of many different block sizes and shapes. This problem even is further compounded by the fact that no two coke ovens are identical.

In view of the above, the industry would also welcome a means of simplifying the construction of combustion chamber assemblies, regardless of the specific structural requirements of individual coke ovens.

As stated earlier, another structural requirement of combustion chamber assemblies is that they should have a means for visually observing whether there is blockage within the individual combustion flues (e.g., a "sight hole"). While often necessary, the construction of this "sight hole" also creates many problems for the person constructing the combustion chamber assembly. For example, sight holes are typically constructed from a plurality of different sized and shaped construction blocks. This, as with the conventional means for constructing the combustion flues within a combustion chamber assembly, even further increases the number of different sized and shaped blocks needed to construct such an assembly unit. As before, the industry would greatly welcome a means by which the construction of sight holes, within a combustion chamber assembly, is simplified.

SUMMARY OF THE INVENTION

It is an object of the present invention to provide a combustion chamber assembly which has an energy efficient seal between adjacent combustion flues defined therein.

It is another object of the present invention to provide a means for simplifying the construction of combustion chamber assemblies by reducing the number of different sized blocks employed in the construction process.

It is still another object of the present invention to provide a means for simplifying the construction of combustion chamber assemblies by reducing the number of blocks employed in the construction process.

It is a further object of the present invention to provide a means for simplifying the construction of the sight holes which open into the individual combustion flues of a combustion chamber assembly.

It is still a further object of the present invention to provide a novelly-shaped construction block for fabricating combustion chamber assemblies.

It is even a further object of the present invention to provide a novelly-shaped construction block for fabricating the sight holes which open into the individual combustion flues of a combustion chamber assembly.

These and other objects are met by the present invention due to the advent of a novel construction block. The construction block of the present invention is a rectangularly-shaped unit having an upper and lower wall surface, a left and right side wall surface and two end wall surfaces. In the construction block of the present invention, at least one of the end wall surfaces is offset along the longitudinal axis of the block's upper and lower wall surfaces to define one half of a horizontally-oriented, L-shaped "lap joint". The construction block of the present invention also comprises: (a) at least one ridge running along at least a portion of the longitudinal axis of the block's upper wall surface and at least one groove running along at least a portion of the longitudinal axis of the block's lower wall surface, (b) at least one groove running along at least a portion of the longitudinal axis of the block's upper wall surface and at least one ridge running along at least a portion of the longitudinal axis of the block's lower wall surface, (c) at least a first ridge running along at least a portion of the longitudinal axis of the block's upper wall surface and at least a second ridge running along at least a portion of the longitudinal axis of the block's lower wall surface, or (d) at least a first groove running along at least a portion of the longitudinal axis of the block's upper wall surface and at least a second groove running along at least a portion of the longitudinal axis of the block's lower wall surface.

Other objects, aspects and advantages of the present invention will become apparent to those skilled in the art upon reading the following detailed description, when considered in conjunction with the accompanying drawings and appended claims.

BRIEF DESCRIPTION OF THE DRAWINGS

A more complete appreciation of the invention, and many attendant advantages thereof, will readily obtained as the same becomes better understood by reference to the following detailed description, when considered in conjunction with the accompanying figures briefly described below.

FIG. 1 is an elevation view of a conventional (prior art) means for constructing one course of a combustion flue within a combustion chamber assembly.

FIG. 2 is an elevation view of a means for constructing one course of a combustion flue within a combustion chamber assembly, in accordance with the present invention.

DETAILED DESCRIPTION OF THE INVENTION

Figure 3:
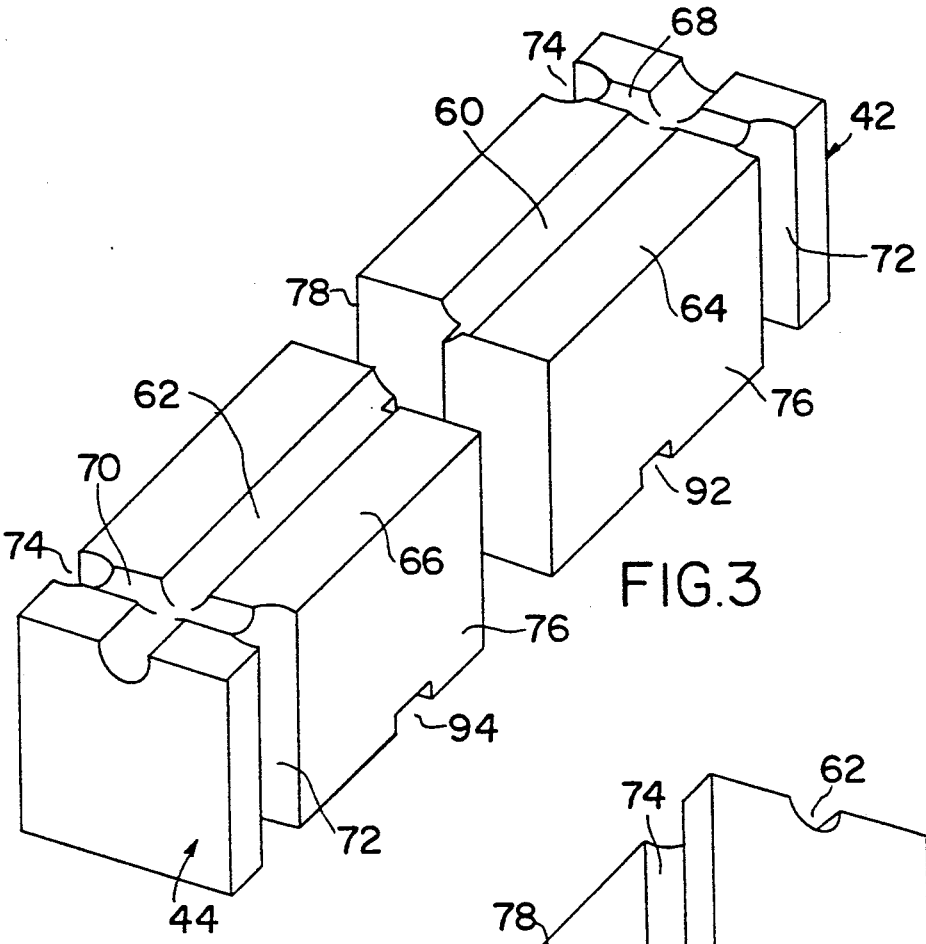
FIG. 3 is a top isometric view of one embodiment of two adjoining dividing wall construction blocks designed in accordance with the present invention.

The novel construction blocks of the present invention remedy many of the inherent problems associated with the conventional means of, constructing of coke ovens, and particularly, the ovens' combustion chamber assemblies. It should be noted, however, that while the novelly-designed construction blocks of the present invention are especially useful for the fabrication of improved combustion chamber assemblies, these blocks can also be employed for the fabrication of other wall units and/or ovens which have inherent problems which are similar to those encountered in conventional coke oven combustion chamber assemblies and/or their construction.

The construction block of the present invention is a rectangularly-shaped unit comprising: (a) an upper and lower wall surface, (b) a left and right side wall surface, and (c) two end wall surfaces, wherein at least one of the end wall surfaces is offset along the longitudinal axis of the block's upper and lower wall surfaces to define one half of a horizontally-oriented, L-shaped lap joint. The construction block of the present invention further comprises: (a) at least one ridge running along at least a portion of the longitudinal axis of the block's upper wall surface and at least one groove running along at least a portion of the longitudinal axis of the block's lower wall surface, (b) at least one groove running along at least a surface and at least one groove running along at least a portion of the longitudinal axis of the block's lower wall surface, (c) at least a first ridge running along at least a portion of the longitudinal axis of the block's upper wall surface and at least a second ridge running along at least a portion of the longitudinal axis of the block's lower wall surface, or (d) at least a first groove running along at least a portion of the longitudinal axis of the block's upper wall surface and at least a second groove running along at least a portion of the longitudinal axis of the block's lower wall surface.

Due to the novel design of the construction blocks of the present invention, many of the problems associated with the conventional means of fabricating combustion chamber assemblies are overcome. For example, by employing the novelly-designed construction blocks of the present invention, gas seepage between adjacent combustion flues is minimized, thus improving the energy-efficiency of the coke oven. This improvement can easily be seen when comparing a conventional means of fabricating one course of a combustion chamber assembly (e.g., FIG. 1), with a means for fabricating one course of a similar combustion assembly in accordance with the present invention (e.g., FIG. 2).

FIG. 1 illustrates one example of a conventional (prior art) means for constructing one course of block useful in the fabrication of a combustion chamber assembly. In FIG. 1, adjacent combustion flues 20 and 22 are separated from one another by dividing wall block 24 (also identified as block "d"). The conventional means for fabricating a combustion chamber assembly also includes outside wall block 26 (also identified as block "b") and block 28 (also identified as block "e"). Furthermore, the conventional means for fabricating a combustion chamber assembly also includes T-shaped end block 30 (also identified as block "a") and T-shaped end block 32 (also identified as block "f").

End surface 34 of dividing wall block 24 is positioned in close, abutting relationship with side wall surface 36 of T-shaped end block 32. This creates a straight head joint partition 33 between combustion flues 20 and 22. Mortar is typically fitted into head joint partition 33 to create a seal between combustion flues 20 and 22.

As stated earlier, combustion flues are typically cycled between a combustion mode and a regeneration mode. Under these circumstances, outside wall blocks 26 and 28, T-shaped end blocks 30 and 32 and dividing wall block 24 expand and contract. This expansion and contraction deteriorates the mortar seal typically placed at the head joint partition 33. Once this seal deteriorates, there will be gas seepage between combustion flues 20 and 22 due to the straight head joint configuration at head joint partition 33.

FIG. 2, on the other hand, is an elevation view of one embodiment of a means for constructing one course of an improved energy-efficient seal between two adjacent combustion flues in accordance with the present invention. Specifically, FIG. 2, illustrates a portion one course of construction blocks used in the construction of a combustion chamber assembly.

The partial course of construction blocks illustrated in FIG. 2 defines combustion flues 38 and 40. The combustion chamber assembly in FIG. 2 employs a two-piece interlocking dividing wall unit made from block 42 (also identified as block "a'") and block 44 (also identified as block "c'") and a one-piece interlocking dividing wall unit made from block 50 (also identified as block "d'"). The combustion chamber assembly of FIG. 2 also includes outside wall block 46 (also identified as block "e'") and outside wall block 48 (also identified as block "b'"). The reason for employing two different types of interlocking dividing wall units will be better understood when FIGS. 6–9 are described later.

As can be seen, the two-piece interlocking dividing wall unit made from blocks 42 and 44 does not have a head joint which butts against the inside surface of the outside of the outside walls. In fact, the longitudinal end wall surfaces, opposite the offset longitudinal end wall surface forming part of the lap joint, forms part of the combustion chamber assembly's outside wall surface.

Since having a one-piece dividing wall unit which spans the entire width of the combustion chamber assembly would be too cumbersome to handle, Applicants designed a two-piece wall unit. However, if the teachings of the industry were employed, the two-piece unit would have a straight partition joint therebetween. This will result with the same problems of gas seepage as are observed in straight head joint of conventional practices. In order to minimize the problem of gas seepage, Applicants offset the abutting longitudinal ends of the two-piece dividing wall unit.

By practicing the present invention, the partition joint 51 between combustion flues 38 and 40 is made by an off-set lap joint in dividing wall block 42 and a corresponding off-set lap joint in dividing wall block 44. The partition joint 51 is positioned between end portion 52 of block 42 and adjacent end portion 54 of block 44. Offset lap joint at end portion 52 of block 42 is designed such that it corresponds with the off-set lap joint at adjacent end portion 54 of block 44.

By practicing the embodiment illustrated in FIG. 2, an improved seal is formed between combustion flues 38 and 40. Specifically, during normal operation of the combustion chamber assembly illustrated therein, dividing wall blocks 42 and 44 will expand and contract as expected. However, due to the offset lap joint partition 51 of FIG. 2 (as opposed to a straight head joint partition 33 of FIG. 1), vertical wall segments 56 and 58 of the corresponding lap joints will still be in relatively close proximity to one another. This minimizes the amount of gas seepage between combustion flues 38 and 40. This, in turn, improves the energy efficiency of the combustion chamber assembly and the entire coke oven.

Another feature of the present invention is that, due to the novelly-designed construction blocks, a fewer number of blocks are needed to construct a combustion chamber assembly. For example, FIG. 1 illustrates a conventional 6-piece construction of a combustion flue in a combustion chamber assembly. In other words, to complete combustion flue 20, six separate blocks are needed. These blocks are identified with letters a, b, c, d, e and f.

On the other hand, FIG. 2 illustrates that, when practicing the present invention, there are only five blocks needed to construct a combustion flue. Specifically, to construct combustion flue 40 blocks a', b', c', d' and e' need be only employed.

Accordingly, by practicing the present invention, a builder would need one less block (per flue/per course) to construct the same combustion chamber assembly as illustrated in FIG. 1. When viewed by the builder of a coke oven, this feature is extremely desirable since: (a) combustion flues typically range from between about 15 through about 50 courses each, (b) the number of combustion flues within a single combustion chamber assembly typically ranges from between about 20 to about 50, and (c) the number of combustion chamber assemblies within a single coke oven typically ranges from between about 10 to about 50.

The novelly-designed construction blocks of the present invention are rectangularly-shaped units comprising: (a) an upper and lower wall surface, (b) a left and right side wall surface and (c) two end wall surfaces, wherein at least one of the end wall surfaces is offset along the longitudinal axis of the blocks' upper and lower wall surfaces to define one half of a horizontally-oriented, L-shaped lap joint.

The offset configuration of the construction blocks made in accordance with the present invention result in the offset end wall surface having two vertically-oriented end wall segments which are generally parallel to, and offset from, one another. The planar surfaces of these two vertically-oriented end wall segments are also generally perpendicular to the planar surfaces of the block's upper and lower walls.

In addition to the two vertically-oriented end wall segments the offset end wall surface also has a vertically-oriented connecting wall segment which spans the distance between, and interconnects, the two end wall segments. This vertically-oriented connecting wall segment has a planar surface which is generally parallel to the planar surfaces of the block's upper and lower walls, and which is generally perpendicular to the planar surfaces of the two vertically-oriented end wall segments of the offset end wall surface. Accordingly, this horizontally-oriented, L-shaped lap joint is oriented in the construction block's end wall surface such that the planar configuration of the block's upper wall surface is substantially identical to the planar configuration of the block's lower wall surface.

Due to the offset end wall surface, the upper and lower wall surfaces of the construction blocks designed in accordance with the present invention each have an end wall segment which extends beyond the remaining one end wall segment of the same end wall surface. The distance which the one end wall segment surface extends beyond the other depends upon many different variables such as the specific needs of the builder and the specific combustion chamber assembly into which they will be employed. This distance also depends upon the physical composition of the construction blocks. Specifically, since some construction blocks expand and contract more than others when subjected to the typical thermal conditions encountered in a coke oven, the longitudinal distance between the offset end wall surfaces of a specific dividing wall block may have to vary.

In general, the longitudinal distance between the offset end wall segments of a particular dividing wall block should be such that, when the construction blocks, which are interconnected with one another and which make up the two-piece dividing wall unit contract, at least a portion of the connecting wall segment of one of the dividing wall blocks is aligned with at least a portion of the connecting wall segment of the corresponding dividing wall block. Under normal coke oven combustion and regeneration conditions, one of the end wall segments will extend beyond its corresponding, offset end wall segment by a distance which ranges from between about 12 inches to about 0.25 inch. Preferably, the distance between the corresponding end wall segments of a particular end wall surface ranges from between about 10 inches to about 0.5 inch, even more preferably, from between about 8 inches to about 1 inch.

As stated earlier, the novelly-designed construction blocks of the present invention also comprise (a) at least one ridge running along at least a portion of the longitudinal axis of the blocks' upper surface and at least one groove running along at least a portion of the longitudinal axis of the blocks' lower wall surface, (b) at least one groove running along at least a portion of the longitudinal axis of the blocks' upper wall surface and at least one groove running along at least a portion of the longitudinal axis of the blocks' lower wall surface, (c) at least a first ridge running along at least a portion of the longitudinal axis of the blocks' upper wall surface and at least a second ridge running along at least a portion of the longitudinal axis of the blocks' lower wall surface, and (d) at least a first groove running along at least a portion of the longitudinal axis of the blocks' upper wall surface and at least a second groove running along at least a portion of the longitudinal axis of the blocks' wall lower surface. The specific orientation of grooves and/or ridges depends upon many different variables such as the desires and resources of the particular builder and/or block manufacturer and/or the composition of the construction block. One example of a preferred block configuration, made in accordance with the present invention, is illustrated in FIGS. 3 and 4 which will now be discussed.

Figure 4:
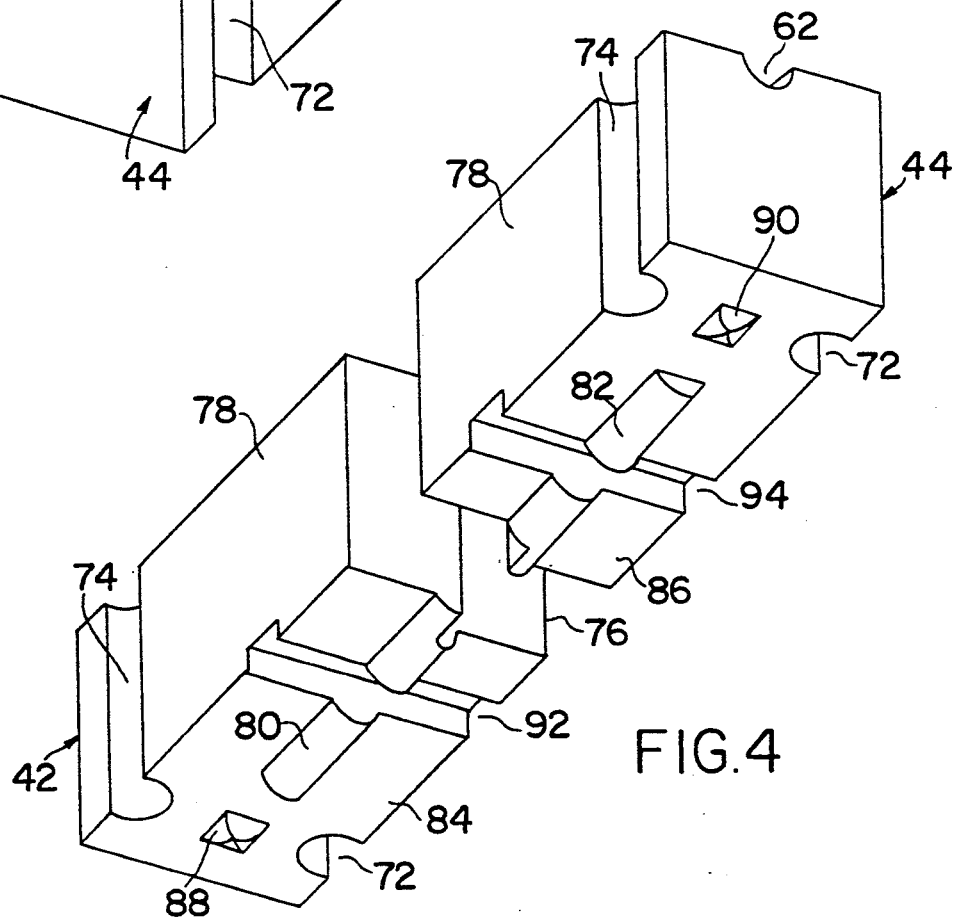
FIG. 4 is a bottom isometric view of the embodiment of the two construction blocks of the present invention illustrated in FIG. 3.

FIGS. 3 and 4 of the present invention are top and bottom isometric views, respectively, illustrating one embodiment of the present invention. Specifically, the configuration and design of the construction blocks illustrated in FIGS. 3 and 4 illustrate a two-piece dividing wall unit to be positioned between two adjacent combustion flues. FIGS. 3 and 4 also illustrate one possible method of positioning grooves and ridges in the surfaces of the construction blocks of the present invention for purposes of interlocking adjacent blocks within the same course, as well as for interlocking adjacent blocks in upper and/or lower courses.

Specifically, FIG. 3 illustrates that grooves 60 and 62 can be defined in the upper surfaces 64 and 66 of dividing wall construction blocks 42 and 44, respectively. Grooves 60 and 62 are preferably positioned along the longitudinal axis of blocks 42 and 44. Grooves 60 and 62 are positioned and dimensioned such that they correspond with a rib(s) from a block(s) positioned to rest on upper surfaces 64 and 66 of blocks 42 and 44.

Upper surfaces 64 and 66 can also, optionally, have defined therein grooves 68 and 70 (seen only in FIG. 3). Grooves 68 and 70 are perpendicular to the longitudinal axis of grooves 60 and 62. Grooves 68 and 70 are also positioned and dimensioned such that they correspond with a rib(s) from a block(s) positioned to rest on upper surfaces 64 and 66 of blocks 42 and 44.

Blocks 42 and 44 further have vertically-oriented grooves 72 and 74 defined in side wall surfaces 76 and 78, respectively. Grooves 72 and 74 are dimensioned and positioned such that they correspond with vertically-oriented ribs from adjacent construction blocks within the same course (see. e.g., FIGS. 2, 6 and 8).

Blocks 42 and 44 further define ridges 80 and 82 in the respective block's lower surfaces 84 and 86 (seen only in FIG. 4). Ridges 80 and 82 are positioned along the longitudinal axis of blocks 42 and 44. Ridges 80 and 82 are dimensioned and positioned such that they correspond with a longitudinally-oriented groove(s) of a block(s) upon which they rest.

On the lower surfaces 84 and 86 of blocks 42 and 4, there is also defined ridges 88 and 90 (seen only in FIG. 4). Ridges 88 and 90 are dimensioned and positioned such that they correspond with grooves in the outside wall block, which correspond, and are aligned, with grooves 68 and 70 of a course of blocks upon which blocks 42 and 44 are positioned to rest.

Finally, blocks 42 and 44 also have defined in their lower surface channels 92 and 94. These channels are positioned to correspond with similar channels located on a block(s) upon which blocks 42 and 44 will rest. The opening defined by the corresponding channels is filled with an interlocking material. Any suitable interlocking material can be employed. A preferred interlocking material is known in the industry as a "soap block".

The interlocking features of the blocks designed in accordance with the present invention would be better appreciated when FIGS. 6–12 are discussed later.

FIGS. 3 and 4 illustrate a preferred design of a two-piece dividing wall unit employed in the construction of a combustion chamber assembly in accordance with the present invention. It should be noted, however, that the particular orientation of grooves and/or ridges illustrated in FIGS. 3 and 4 depend upon many different variables such as the specific structural requirements of a combustion chamber assembly. Applicant has discovered, however, that the implementation of a highly sophisticated interlocking design between adjacent blocks within a particular course and between adjacent blocks within upper and lower courses not only improves the structural integrity of the combustion chamber assembly, but also simplifies the construction of the combustion chamber assembly as well as improves the heat efficiency thereof.

FIGS. 3*a* and 4*a*, 3*b* and 4*b*, and 3*c* and 4*c* illustrate three other examples of embodiments of possible block designs encompassed by the present invention.

Figure 3A:
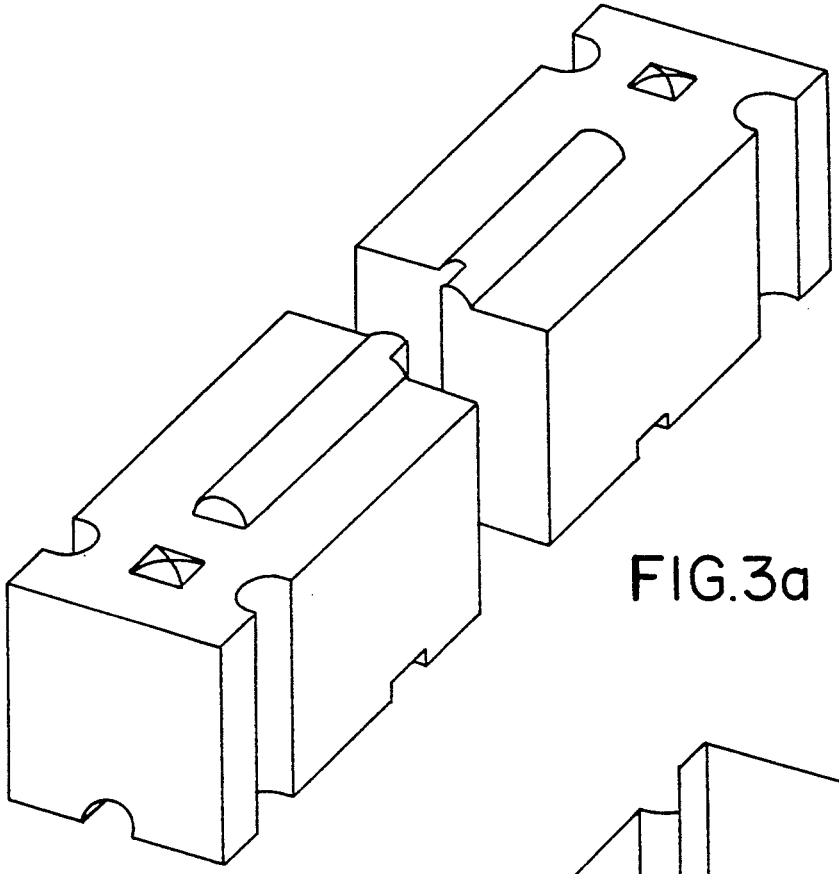
FIG. 3*a* is a top isometric view of one embodiment of two adjoining dividing wall construction blocks designed in accordance with the present invention.
Figure 4A:
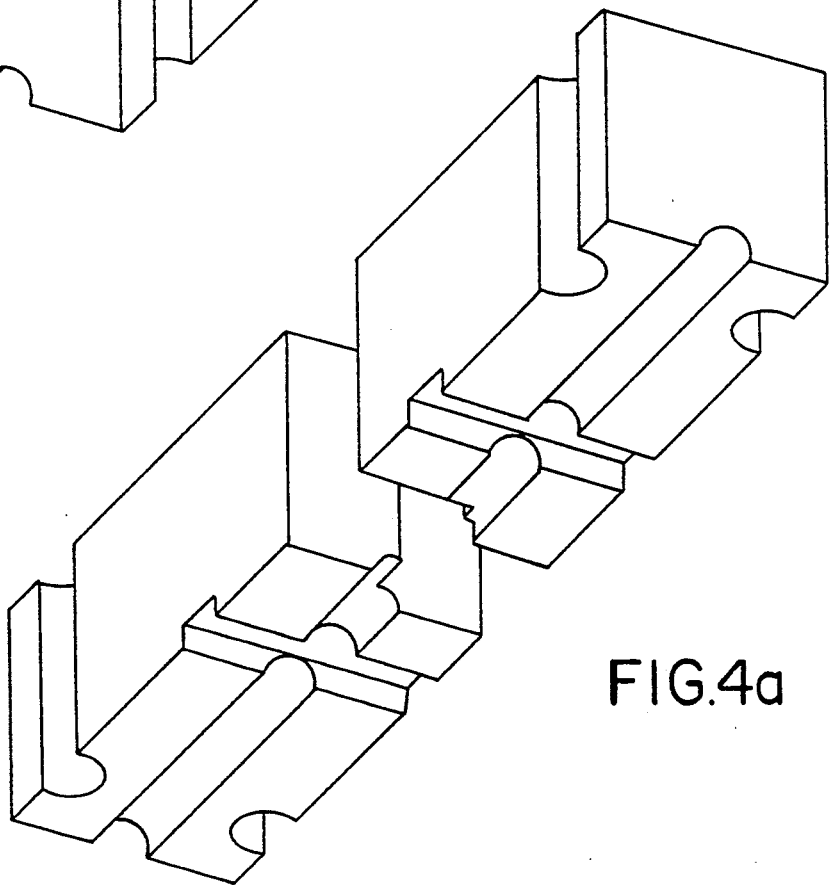
FIG. 4*a* is a bottom isometric view of the embodiment of the two construction blocks of the present invention illustrated in FIG. 3*a*.

Specifically, FIGS. 3*a* and 4*a* are top and bottom isometric views, respectively, illustrating a two-piece dividing wall unit which can be positioned between two adjacent combustion flues. The embodiment illustrated in FIGS. 3*a* and 4*a* is one wherein the construction block's upper wall surface comprises at least one ridge running along at least a portion of the longitudinal axis of the construction block's upper wall surface, and at least one groove running along at least a portion of the longitudinal axis of the construction block's lower wall surface.

Figure 3B:
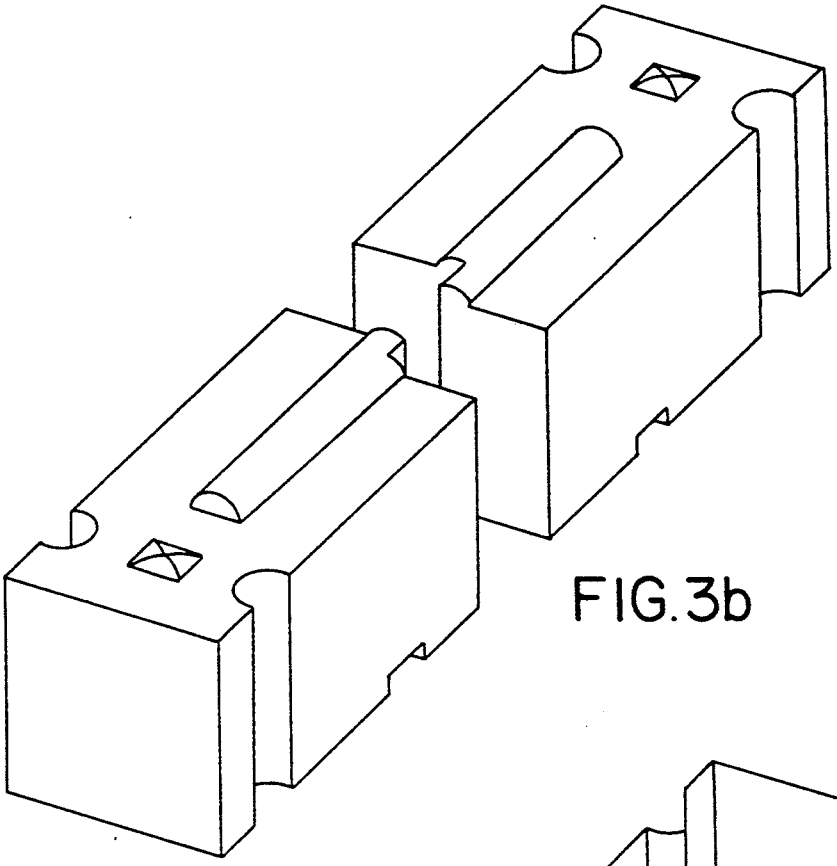
FIG. 3*b* is a top isometric view of one embodiment of two adjoining dividing wall construction blocks designed in accordance with the present invention.
Figure 4B:
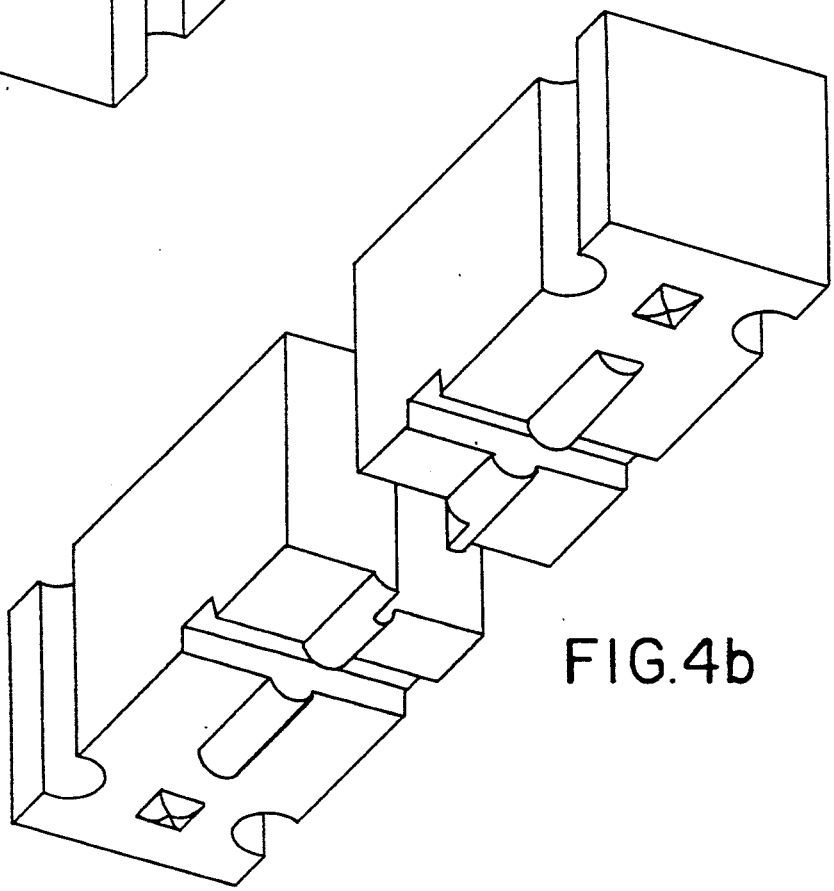
FIG. 4*b* is a bottom isometric view of the embodiment of the two construction blocks of the present invention illustrated in FIG. 3*b*.

FIGS. 3*b* and 4*b* are top and bottom isometric views, respectively, also illustrating a two-piece dividing wall unit which can be positioned between two adjacent combustion flues. The embodiment illustrated in FIGS. 3*b* and 4*b* is one wherein the construction block's upper wall surface comprises at least one ridge running along a least a portion of the longitudinal axis of the construction block's upper wall surface, and at least one ridge running along at least a portion of the longitudinal axis of the construction block's lower wall surface.

Figure 3C:
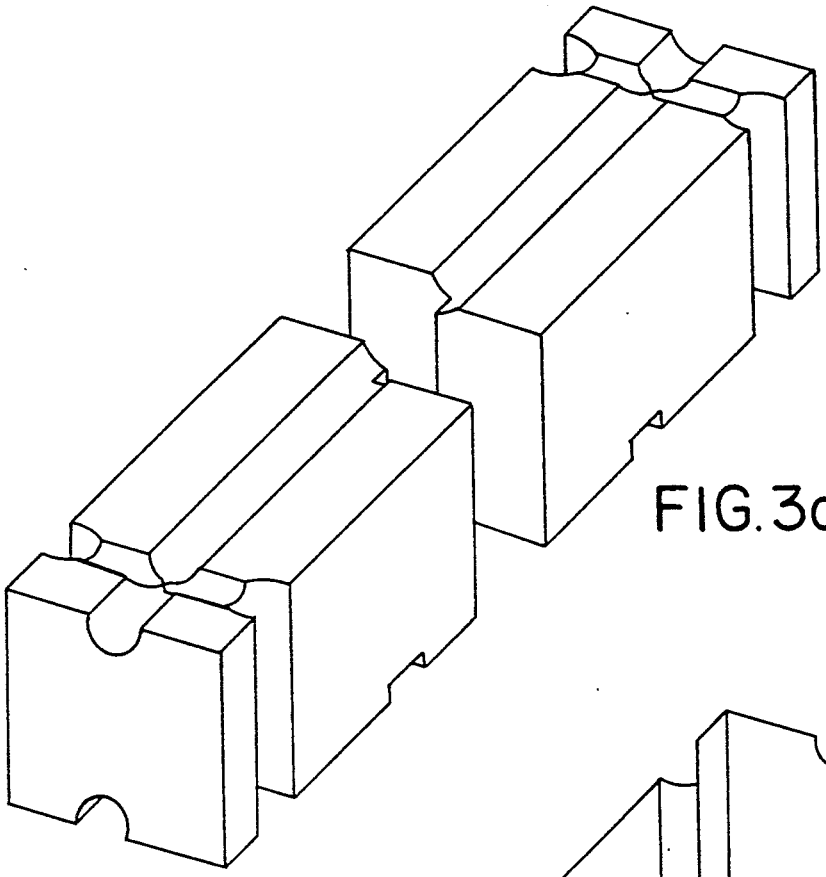
FIG. 3*c* is a top isometric view of one embodiment of two adjoining dividing wall construction blocks designed in accordance with the present invention.
Figure 4C:
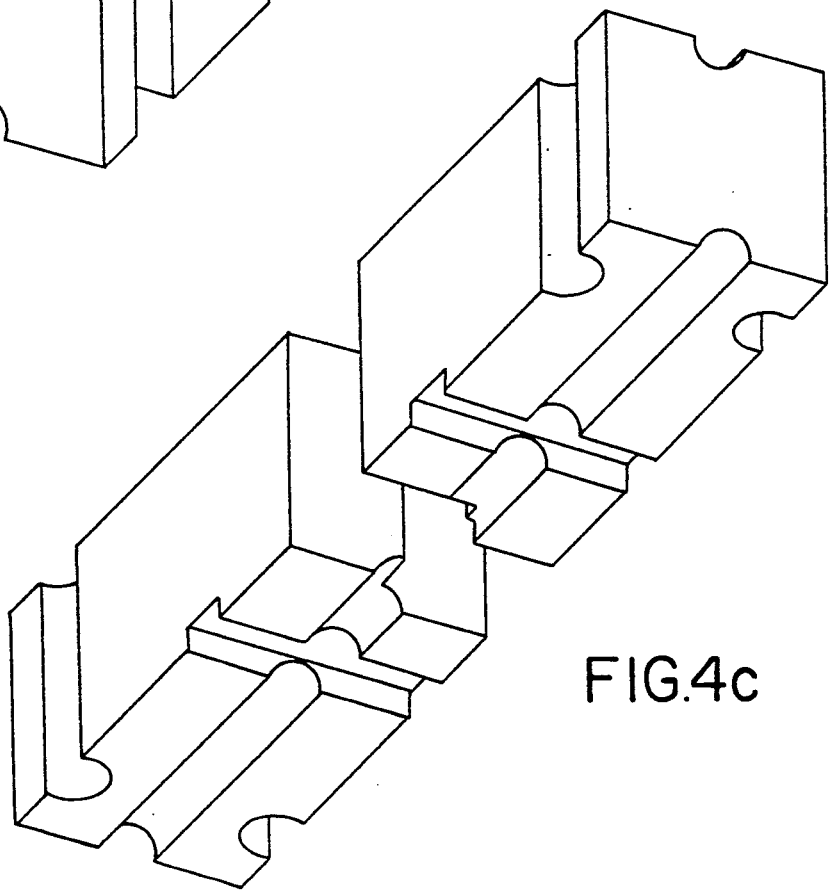
FIG. 4*c* is a bottom isometric view of the embodiment of the two construction blocks of the present invention illustrated in FIG. 3*c*.

FIGS. 3*c* and 4*c* are top and bottom isometric views, respectively, further illustrating yet another two-piece dividing wall which can be positioned between two adjacent combustion flues. The embodiment illustrated in FIGS. 3*c* and 4*c* is one wherein the construction block's upper wall surface comprises at least one groove running along at least a portion of the longitudinal axis of the construction block's upper wall surface, and at least one groove running along at least a portion of the longitudinal axis of the construction block's lower wall surface.

As stated earlier, another feature of the present invention is the implementation of the novelly-designed construction blocks to construct a sight hole which opens into the individual combustion flues. One example of a means by which a sight hole can be fabricated by employing blocks designed in accordance with the present invention is illustrated in FIG. 5 which will now be discussed.

Figure 5:
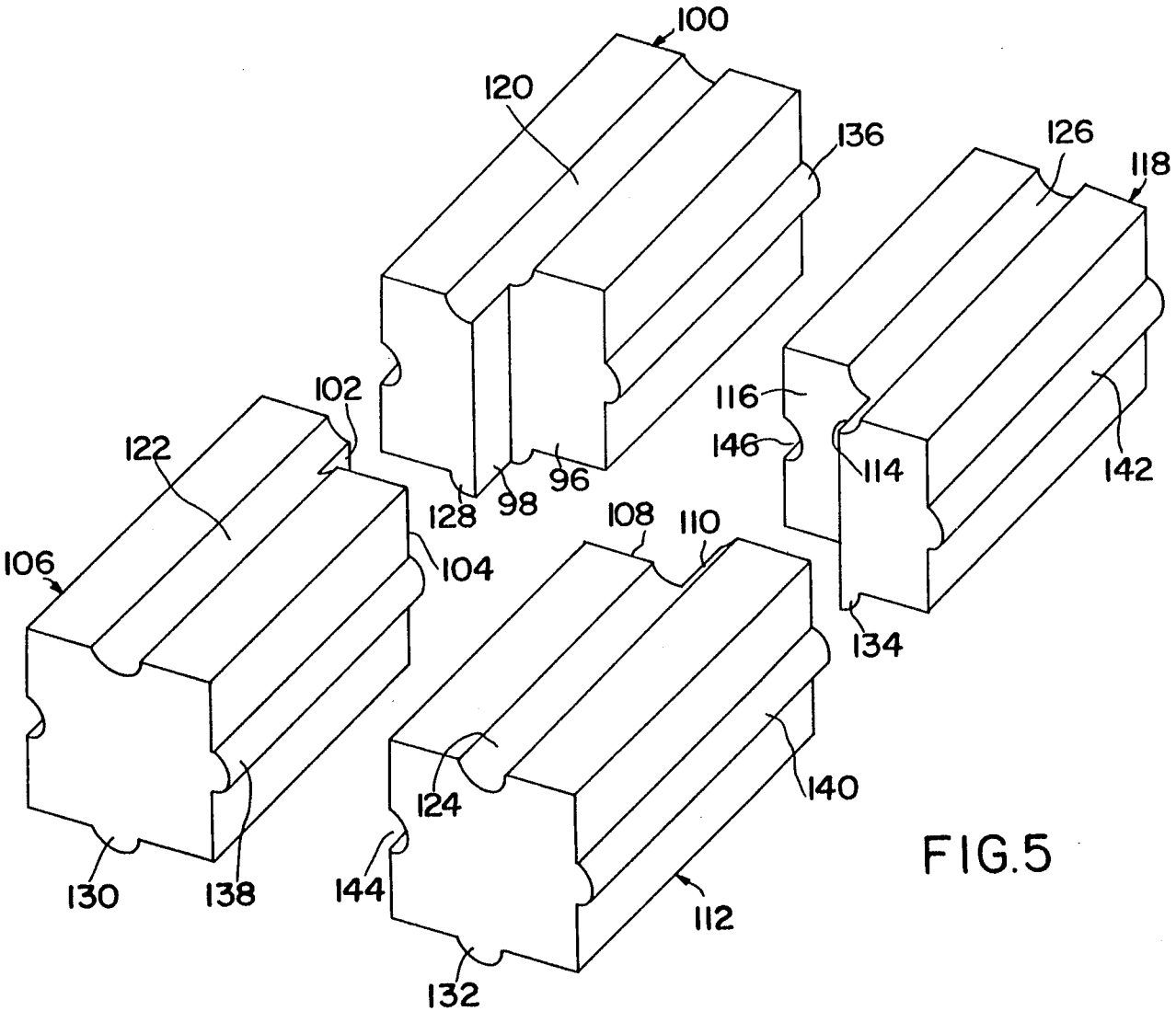
FIG. 5 is a top isometric view illustrating one means of implementing construction blocks designed in accordance with the present invention to construct one course of a sight hole.

FIG. 5 illustrates a means by which a construction block, designed in accordance with the present invention, can be employed to fabricate a sight hole in a combustion chamber assembly. As shown in FIG. 5, by manipulating the orientation of one novelly-designed construction blocks, a sight hole can be easily constructed. Specifically, this sight hole is defined in part by lap joint wall segments 96 and 98 of block 100; lap joint wall segments 102 and 104 of block 106; lap joint wall segments 108 and 110 of block 112; and lap joint wall segments 114 and 116 of block 118.

Blocks 100, 106, 112 and 118 each have a groove 120, 122, 124 and 126, respectively, defined in their upper wall surface. Moreover, blocks 100, 106, 112 and 118 also have a ridge 128, 130, 132 and 134, respectively, defined in their lower wall surface.

Optionally, blocks 100, 106, 112 and 118 can further comprise a horizontally-oriented ridge 136, 138, 140 and 142, respectively, defined in at least one of the blocks' side wall surfaces. If present, these ridges should preferably correspond with grooves in an adjacent block's side wall surface which will abut thereagainst. For example, in the embodiment illustrated in FIG. 5, blocks 112 and 118 have defined in their left side wall surfaces grooves 144 and 146, respectively. Grooves 144 and 146 are positioned and dimensioned in the side wall surfaces of blocks 112 and 118 such that they correspond with ridges 138 and 136 defined in adjoining blocks 106 and 100, respectively.

Figure 10:
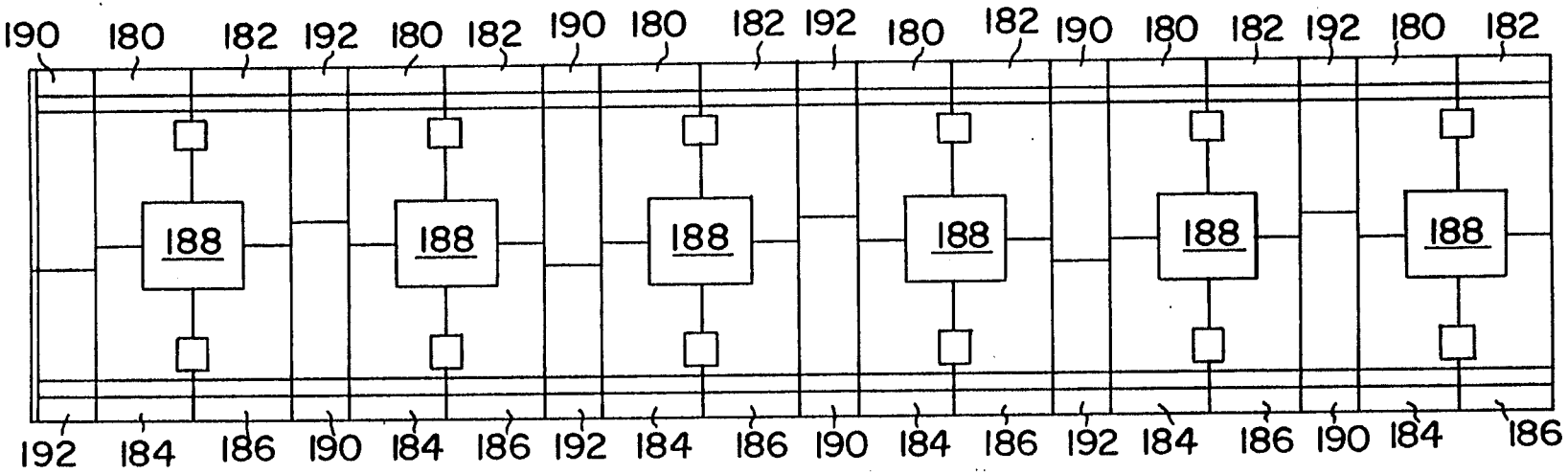
FIG. 10 is a top view of a portion of a course of construction blocks employed in the construction of sight holes in accordance with the present invention.
Figure 11:
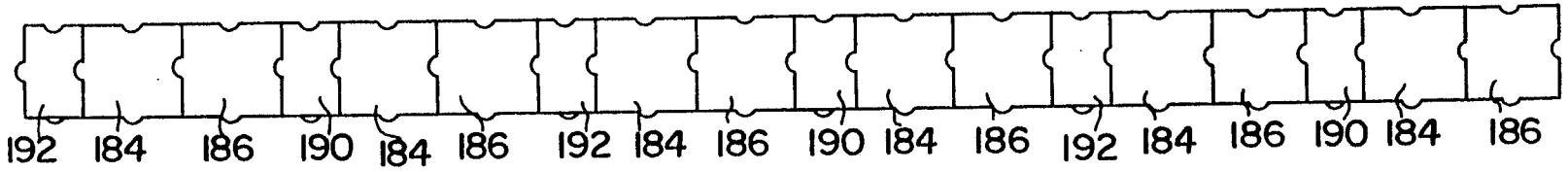
FIG. 11 is a side view of the course of construction blocks illustrated in FIG. 10.
Figure 12:
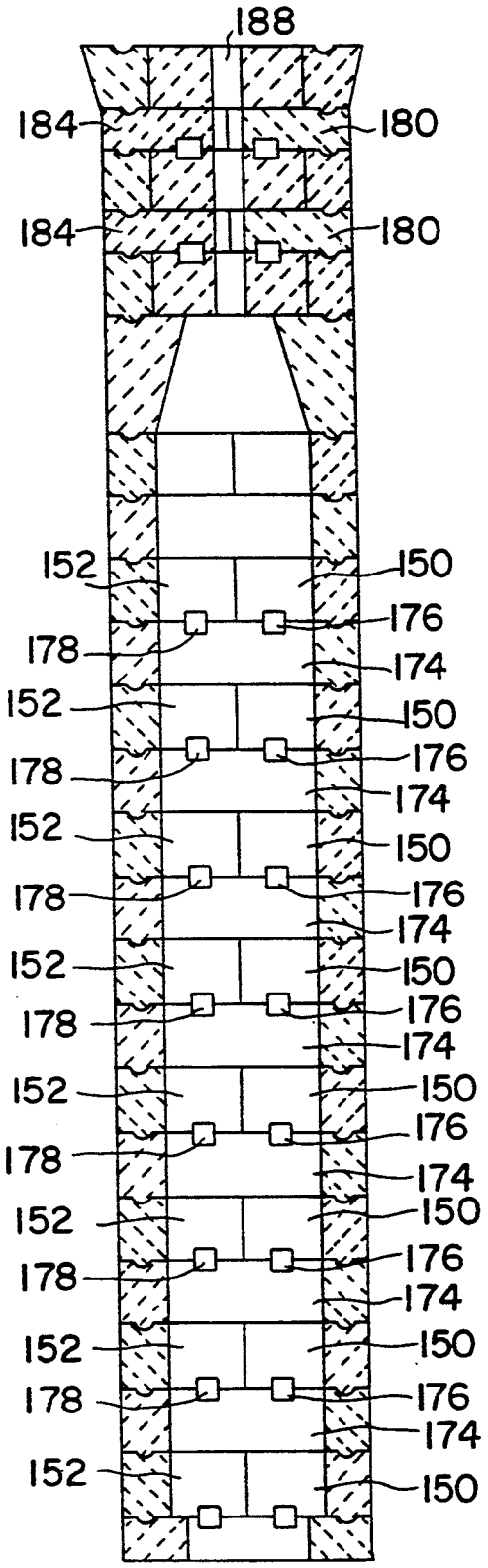
FIG. 12 is a cross-sectional view of a combustion chamber assembly, through a combustion flue and accompanying sight hole, constructed by the implementation of blocks designed in accordance with the present invention.

The incorporation of the construction blocks designed in accordance with the present invention to define a sight hole better will be understood when FIGS. 10–12 are discussed later.

Figure 6:
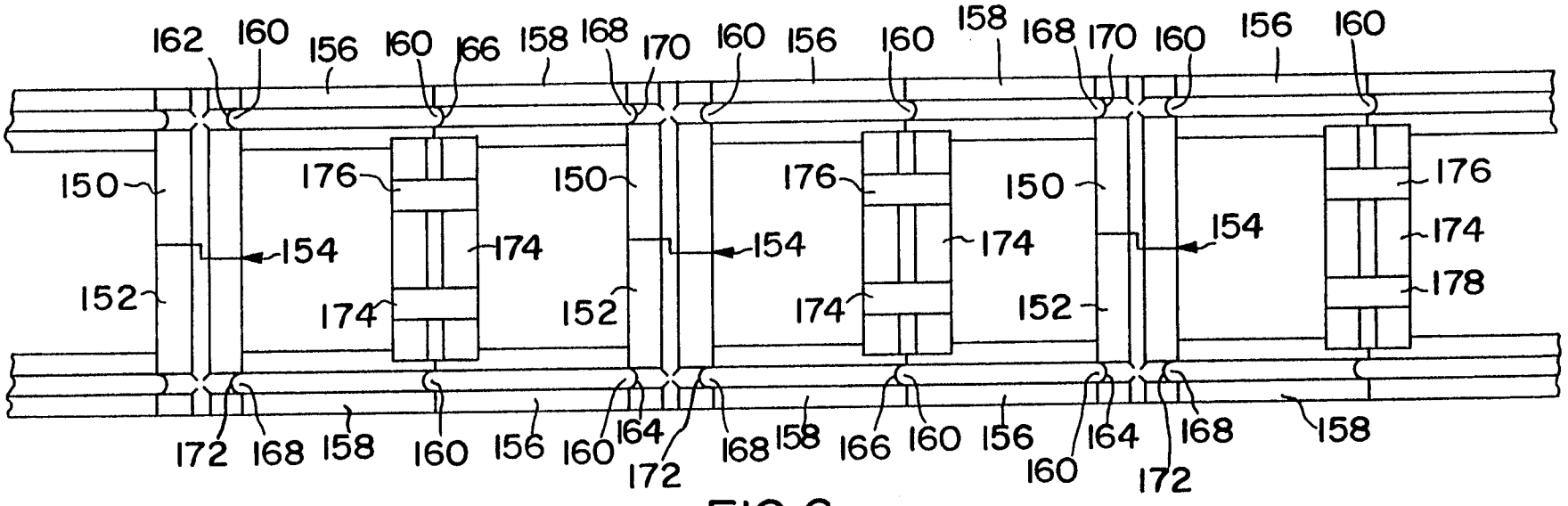
FIG. 6 is a top view of a portion of a course of construction blocks employed in the construction of a combustion chamber assembly in accordance with the present invention.

FIGS. 6–12 illustrate the implementation of construction blocks designed in accordance with the present invention to fabricate a combustion chamber assembly defining a plurality of combustion flues. FIG. 6 clearly illustrates the 5-piece construction of a combustion flue by the implementation of the two-piece interlocking dividing wall unit made by construction blocks 150 and 152 wherein the two-piece unit has a lap joint 154 formed therebetween, and the one-piece interlocking dividing wall unit made by block 174.

In addition to the above, the 5-piece construction configuration further comprises outside wall blocks 156 and 158. Outside wall block 156 has a vertically-oriented ridge 160 on both of its longitudinal ends. These vertically-oriented ridges are dimensioned to fit within, and interlock with, vertically-oriented grooves 162, 164 and 166 in interlocking dividing wall blocks 150 and 152 and in outside wall block 158, respectively.

In addition to vertically-oriented groove 166, outside wall block 158 further comprises a vertically-oriented ridge 168 which is dimensioned and positioned to fit within vertically-oriented grooves 170 and 172 defined in interlocking dividing wall blocks 150 and 152, respectively.

As stated above, block 174 is a one-piece interlocking dividing wall unit which is staggered between the two-piece interlocking dividing wall unit made from blocks 150 and 152. The length of interlocking dividing wall block 174 is such that it spans the entire width of the combustion flue and fits within a U-shaped slot formed by partially by horizontally-oriented L-shaped lap joint defined in outside wall block 156 and partially by a horizontally-oriented, L-shaped lap joint defined in outside wall block 158.

The upper wall surface of interlocking dividing wall block 174 comprises two channels 176 and 178 which are perpendicular to the block's longitudinal axis. Channels 176 and 178 are positioned in the upper wall surface of interlocking dividing wall block 174 such that they correspond with similar channels in the lower surface of a two-piece interlocking dividing wall unit formed by blocks 150 and 152. See, for example, channels 92 and 94 illustrated in FIG. 4 and also channels 176 and 178 in FIG. 12.

Figure 8:
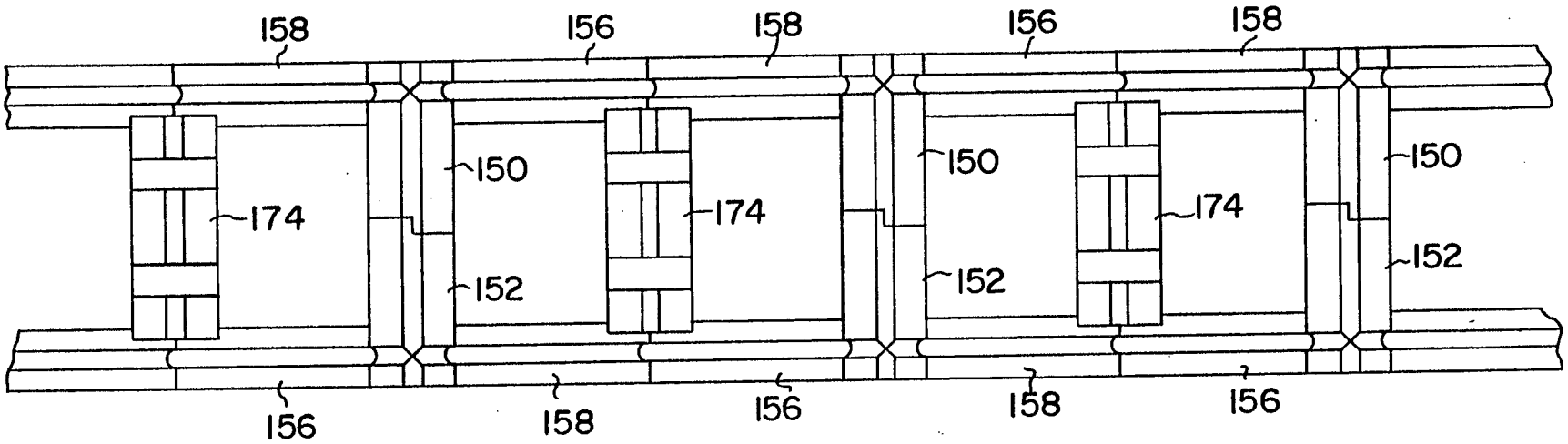
FIG. 8 is a top view of a portion of a course of construction blocks employed in the construction of a combustion chamber assembly in accordance with the present invention.
Figure 9:
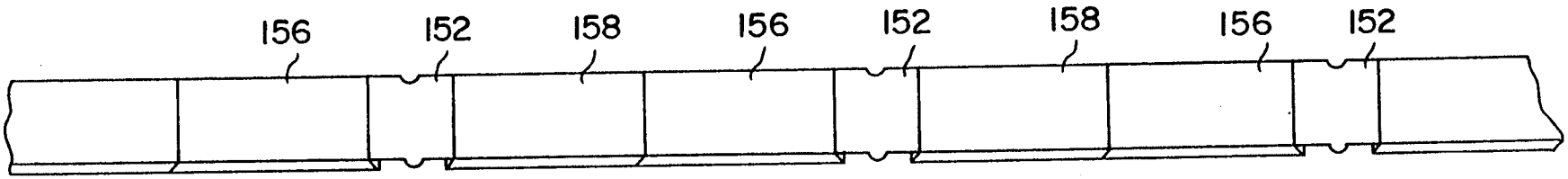
FIG. 9 is a side view of the course of construction blocks illustrated in FIG. 8.

FIGS. 8 and 9 illustrate another course of blocks useful in constructing a combustion chamber assembly in accordance with the present invention. The 5-piece construction of a combustion flue, in accordance with the practice of the present invention, can easily be seen again in FIG. 8. For example, as with FIG. 6, the course of construction blocks illustrated in FIG. 8 includes: (a) the two-piece interlocking dividing wall unit made by blocks 150 and 152; (b) outside wall blocks 156 and 158; and (c) the one-piece interlocking dividing wall unit made from block 174.

Figure 7:
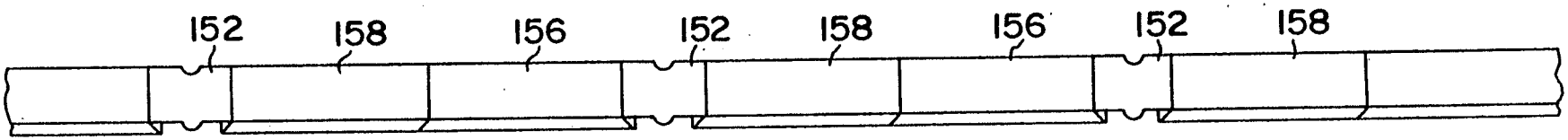
FIG. 7 is a side view of the course of construction blocks illustrated in FIG. 6.

In operation, the course of construction blocks illustrated in FIGS. 8 and 9 are positioned on and/or under the course of construction blocks illustrated in FIGS. 6 and 7 such that the one-piece interlocking dividing wall unit blocks 174 of FIGS. 8 and 9 rests upon the two-piece interlocking dividing wall unit blocks 150 and 152 of FIGS. 6 and 7. Similarly, the two-piece interlocking dividing wall unit blocks 150 and 152 of FIGS. 8 and 9 will rest upon the one-piece interlocking dividing wall unit block 174 of FIGS. 6 and 7.

As stated earlier, when the two-piece interlocking dividing wall unit blocks 150 and 152 are positioned such that they rest upon the one-piece interlocking dividing wall unit blocks 174 of FIGS. 6 and 7 and vice versa channels 176 and 178 will be positioned between the upper wall surface of blocks 174 and the lower wall surface of blocks 150 and 152. Within these channels will be fitted a means for interlocking the blocks of adjacent courses together. As stated earlier, any suitable interlocking means and/or material can be used for this purpose. An example of one such preferred interlocking means is the implementation of "soap blocks".

The rows of construction blocks illustrated in FIGS. 6 and 8 are alternated and positioned one on top of another until the desired height of the combustion flue is achieved.

As stated earlier, combustion chamber assemblies also comprise sight holes by which each combustion flue can be inspected. One means for constructing sight holes in combustion chamber assemblies in accordance with the present invention is illustrated in FIGS. 10 and 11 which will now be discussed.

FIGS. 9 and 10 illustrate the means by which a plurality of sight holes can be defined within a combustion chamber assembly. The means by which sight holes are manufactured in accordance with the present invention comprises the manipulation of construction blocks having a horizontally-oriented, L-shaped lap joint at least one of their longitudinal ends. In FIG. 10, each sight hole is made from a manipulation of construction blocks 180, 182, 184 and 186. The sight holes defined by manipulation of blocks 180, 182, 184 and 186 are generally represented by reference numeral 188.

The course of blocks illustrated in FIGS. 10 and 11 further include spacer blocks 190 and 192. The purpose of spacer blocks 190 and 192 are to position sight holes 188 directly over their respective combustion flues.

FIG. 12 is a cross-sectional view of a combustion chamber assembly passing through one combustion flue and a sight hole. FIG. 12 clearly shows the interlocking mode between the two-piece interlocking dividing wall unit blocks 150 and 152 and the one-piece interlocking dividing wall unit block 174. FIG. 12 further illustrates the formation of channels 176 and 178 in which interlocking means (e.g., "soap blocks") are positioned. Moreover, FIG. 12 also illustrates the formation of sight hole 188 by construction blocks 180 and 184, which are shown, and blocks 182 and 186 which are not shown.

Figure 13:
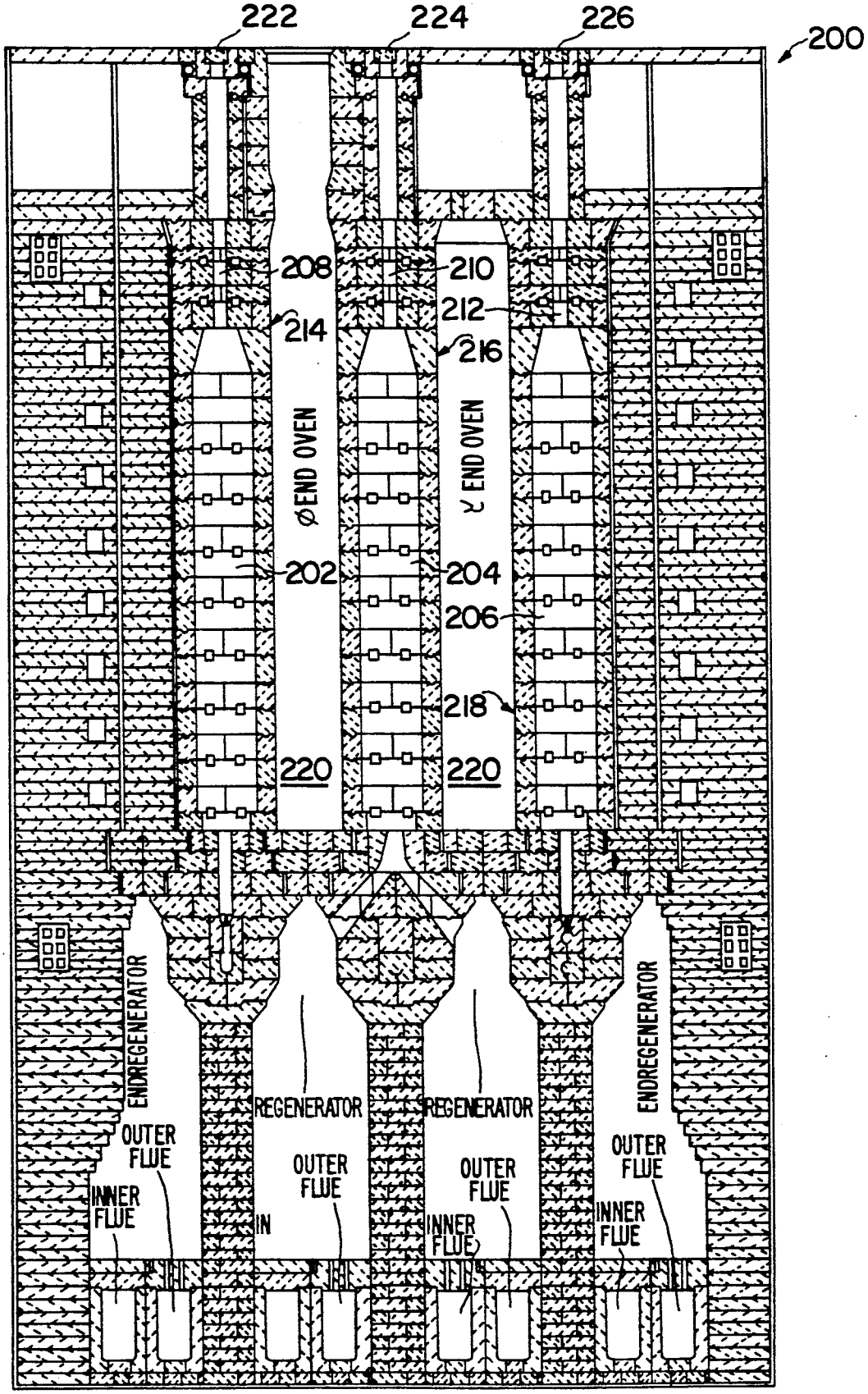
FIG. 13 is a cross-sectional view of a coke oven employing combustion chamber assemblies constructed with construction blocks designed in accordance with the present invention.

FIG. 13 is a cross-sectional view of a coke oven generally referred to by reference numeral 200. The cross-sectional view of coke oven 200 is cut through end combustion flues 202, 204 and 206, and their respective sight holes 208, 210 and 212. Combustion flues 202, 204 and 206 are defined within three laterally-spaced combustion chamber assemblies 214, 216 and 218 to form ovens 220.

During operation, a cap means 222, 224 and 226 are placed over sight holes 208, 210 and 212, respectively. Moreover, combustion chamber assemblies 204 are positioned over regenerators 210.

As can be seen, the combustion chamber assemblies of the present invention can easily be implemented into a conventional coke oven design. Although this implementation will not substantially change the outward appearance of the coke oven, it will greatly improve structural integrity, and energy efficiency, of the oven.

The construction blocks designed in accordance with the present invention can be manufactured by any suitable means known to those skilled in the art. Examples of such suitable means include, but are not limited to: molding, casting and/or extruding. The preferred method of production depends largely upon the resources and facilities available to the particular block manufacturer.

If a casting or molding method of production is employed, the construction blocks of the present invention can be manufactured in either a one-step or a multi-step process. However, if the method selected for producing construction blocks in accordance with the present invention is by extrusion, a multi-step process must be employed.

The composition of the construction blocks made in accordance with the present invention depends upon many variable such as the specific conditions encountered by the particular coke ovens in which the blocks will be employed. The construction blocks encompassed by the present invention can be made by any suitable material. Examples of suitable materials include, but are not limited to: refractory materials (e.g., pyrophyllite-andalusite, fire clay, bauxite, cordierite, etc.), clay, silica, concrete, terra cotta, polymeric materials, brick, and the like, and/or any combination thereof. While the preferred construction material depends largely on the specific physical and thermal conditions of the particular coke oven in which the blocks will be employed, in most conventional coke ovens, it is presently preferred to construct the blocks from refractory-type materials, particularly, pyrophyllite-andalusite blends as supplied by North State Pyrophyllite of Greensboro, N.C.

It is evident from the foregoing that various modifications can be made to embodiments of this invention without departing from the spirit and scope thereof, which will be apparent to those skilled in the art. Having thus described the invention, it is claimed as follows.

That which is claimed is:

1. A combustion chamber assembly, having defined therein a plurality of vertically-oriented combustion flues, wherein at least one horizontal layer of at least one of said plurality of combustion flues is defined in part by: two laterally-spaced outside wall construction blocks generally parallel to, and aligned with, one another; a one-piece interlocking wall unit which interconnects the two outside wall blocks, said one-piece interlocking wall unit having a longitudinal axis which is generally perpendicular to the longitudinal axis of each of said outside wall blocks; and a two-piece interlocking wall unit which is laterally spaced from, and generally parallel to, said one-piece interlocking wall unit, and which interconnects said two outside wall blocks, and wherein said two-piece interlocking wall unit comprises two corresponding, rectangularly-shaped construction blocks each comprising:

(a) an upper and lower wall surface, wherein said construction block's upper wall surface comprises at least one ridge running along at least a portion of the longitudinal axis of said construction block's upper wall surface or at least one groove running along at least a portion of the longitudinal axis of said construction block's upper wall surface, and wherein said construction block's lower wall surface comprises at least one ridge running along at least a portion of the longitudinal axis of said construction block's lower wall surface, or at least one groove running along at least a portion of the longitudinal axis of said construction block's lower wall surface, (b) a left and right side wall surface, and (c) two end wall surfaces, wherein one of said two end wall surfaces is offset along the longitudinal axis of said construction block's upper and lower wall surfaces to define one-half of a horizontally-oriented, L-shaped lap joint, the horizontally-oriented, L-shaped lap joints from each of the rectangularly-shaped construction blocks making said two-piece interlocking wall unit are positioned and dimensioned such that their respective offset end wall surfaces correspond with, and are in close-abutting relationship with, one another.

2. A coke oven comprising a plurality of vertically-oriented combustion chamber assemblies, wherein each of said plurality of combustion chamber assemblies defines therein a plurality of vertically-oriented combustion flues, and wherein at least one horizontal layer of at least one of said plurality of combustion flues being defined in part by: two laterally-spaced outside wall construction blocks generally parallel to, and aligned with, one another; a one-piece interlocking dividing wall unit which interconnects the two outside wall blocks, said one-piece interlocking wall unit having a longitudinal axis which is generally perpendicular to the longitudinal axis of each of said outside wall blocks; and, a two-piece interlocking dividing wall unit which is laterally spaced from, and generally parallel to, said one-piece interlocking wall unit, and which interconnects said two outside wall blocks, said two-piece interlocking wall unit comprises two corresponding, rectangularly-shaped construction blocks each comprising:

(a) an upper and lower wall surface, wherein said construction block's upper wall surface comprises at least one ridge running along at least a portion of the longitudinal axis of said construction block's upper wall surface or at least one groove running along at least a portion of the longitudinal axis of said construction block's upper wall surface, and wherein said construction block's lower wall surface comprises at least one ridge running along at least a portion of the longitudinal axis of said construction block's lower wall surface, or at least one groove running along at least a portion of the longitudinal axis of said construction block's lower wall surface, (b) a left and right side wall surface, and (c) two end wall surfaces, wherein one of said two end wall surfaces is offset along the longitudinal axis of said construction block's upper and lower wall surfaces to define one-half of a horizontally-oriented, L-shaped lap joint, the horizontally-oriented, L-shaped lap joints from each of the rectangularly-shaped construction blocks making said two-piece interlocking wall unit are positioned and dimensioned such that their respective offset end wall surfaces correspond with, and are in close-abutting relationship with, one another.

* * * * *

UNITED STATES PATENT AND TRADEMARK OFFICE

CERTIFICATE OF CORRECTION

PATENT NO. : 5,137,603

DATED : August 11, 1992

INVENTOR(S) : Reuben B. Arthur, Jr. et al.

It is certified that error appears in the above-identified patent and that said Letters Patent is hereby corrected as shown below:

Column 5, line 17, after "least a" and before "surface" on line 18 insert --Portion of the longitudinal axis of the block's upper wall--

Column 9, line 17, after "and" (second occurrence) delete "4" and substitute therefor --44--.

Signed and Sealed this

Twelfth Day of October, 1993

*Attest:*

*Attesting Officer*

Bruce Lehman

BRUCE LEHMAN

*Commissioner of Patents and Trademarks*